US010895040B2

(12) United States Patent
Watkins et al.

(10) Patent No.: US 10,895,040 B2
(45) Date of Patent: Jan. 19, 2021

(54) METHOD AND APPARATUS FOR REMOVING WATER FROM A CAPILLARY CYLINDER IN A PAPERMAKING PROCESS

(71) Applicant: The Procter & Gamble Company, Cincinnati, OH (US)

(72) Inventors: Eric James Watkins, Lawrenceburg, IN (US); Jonathan Lee Price, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 11 days.

(21) Appl. No.: 16/207,280

(22) Filed: Dec. 3, 2018

(65) Prior Publication Data

US 2019/0169796 A1 Jun. 6, 2019

Related U.S. Application Data

(60) Provisional application No. 62/595,184, filed on Dec. 6, 2017.

(51) Int. Cl.
*D21F 11/14* (2006.01)
*F26B 13/14* (2006.01)
(Continued)

(52) U.S. Cl.
CPC ..... *D21F 11/145* (2013.01); *D21F 5/021* (2013.01); *D21F 5/143* (2013.01); *F26B 5/02* (2013.01);
(Continued)

(58) Field of Classification Search
CPC ..... F26B 13/14; F26B 13/28; F26B 13/30; D21F 1/145; D21F 5/021; D21F 5/143; D21F 5/02
(Continued)

(56) References Cited

U.S. PATENT DOCUMENTS 2,939,223 A * 6/1960 Smith ..... D06B 15/06 34/58
3,113,225 A 12/1963 Kleesattel et al.
(Continued)

FOREIGN PATENT DOCUMENTS

CA 2474489 C * 4/2012 ..... F26B 11/02
JP 2019116713 A * 7/2019 ..... D21F 11/006
WO WO-2016049475 A1 * 3/2016 ..... D21F 7/083

*Primary Examiner* — Stephen M Gravini
(74) *Attorney, Agent, or Firm* — Richard L. Alexander; Charles R. Matson

(57) ABSTRACT

The present disclosure relates to methods and apparatuses for removing water from a wet fibrous web. During the process of making a fibrous structure, a capillary dewatering apparatus remove water from a wet porous web. In some configurations, a capillary dewatering apparatus may include a capillary porous media. A molding member, such as a papermaking belt comprising an air permeable fabric, may advance the wet fibrous web onto the capillary porous media, wherein the fibrous web is positioned between the capillary porous media and the air-permeable fabric. An energy transfer surface may be positioned in contact with the air-permeable fabric or the outer circumferential surface, wherein the energy transfer surface operates to vibrate the capillary porous media. In turn, the vibration helps to drive water through the capillary porous media, allowing additional water to flow from the fibrous web and through pores in the capillary porous media.

23 Claims, 3 Drawing Sheets

(51) Int. Cl.

| | |
|---|---|
| ***F26B 13/30*** | (2006.01) |
| ***D21F 5/14*** | (2006.01) |
| ***F26B 5/02*** | (2006.01) |
| ***D21F 5/02*** | (2006.01) |
| ***F26B 13/28*** | (2006.01) |

(52) U.S. Cl.
CPC ..... *F26B 13/14* (2013.01); *F26B 13/28* (2013.01); *F26B 13/30* (2013.01)

(58) Field of Classification Search
USPC ..... 34/453, 110–124
See application file for complete search history.

(56) References Cited

U.S. PATENT DOCUMENTS 3,301,746 A 1/1967 Sanford et al.
3,472,295 A * 10/1969 Bodine ..... B27L 5/00 144/364
3,562,041 A 2/1971 Robertson
3,733,238 A 5/1973 Long et al.
3,750,306 A * 8/1973 Rodwin ..... D21F 5/006 34/69
3,965,581 A * 6/1976 Candor ..... B01D 21/0009 34/252
4,440,597 A 4/1984 Wells et al.
4,514,345 A 4/1985 Johnson et al.
4,556,450 A 12/1985 Chuang et al.
4,729,175 A * 3/1988 Beard ..... D21F 3/02 34/146
4,773,166 A * 9/1988 Candor ..... B01D 21/0009 219/772
4,934,067 A * 6/1990 Wedel ..... D21F 5/042 34/457
5,110,403 A 5/1992 Ehlert
5,598,643 A 2/1997 Chuang et al.
5,689,900 A * 11/1997 Takayama ..... F26B 13/10 34/631
5,830,321 A 11/1998 Lindsay et al.
6,036,796 A 3/2000 Halbert et al.
6,085,437 A * 7/2000 Stipp ..... D21F 5/006 34/115
6,398,910 B1 6/2002 Burazin et al.
6,508,641 B1 1/2003 Kubik
6,610,173 B1 8/2003 Lindsay et al.
6,645,330 B2 11/2003 Pargass et al.
6,701,637 B2 * 3/2004 Lindsay ..... D21F 5/004 162/206
6,733,634 B2 5/2004 Van Rengen et al.
6,746,573 B2 * 6/2004 Stelljes, Jr. ..... D21F 5/182 162/205
7,399,378 B2 7/2008 Edwards et al.
7,494,563 B2 2/2009 Edwards et al.
7,841,103 B2 * 11/2010 Hada ..... D21F 5/182 100/170
7,951,269 B2 * 5/2011 Herman ..... D21F 11/006 162/358.3
8,152,958 B2 4/2012 Super et al.
8,293,072 B2 10/2012 Super et al.
8,328,985 B2 12/2012 Edwards et al.
8,544,184 B2 * 10/2013 Da Silva ..... D21F 5/182 162/358.1
9,322,136 B2 4/2016 Ostendorf et al.
9,528,760 B2 * 12/2016 Maehara ..... C08J 9/26
10,139,162 B2 * 11/2018 Plavnik ..... F26B 7/00
2013/0199741 A1 8/2013 Stage et al.
2016/0090692 A1 3/2016 Eagles et al.
2016/0090693 A1 3/2016 Eagles et al.
2016/0090698 A1 3/2016 Sze et al.
2016/0159007 A1 6/2016 Miller, IV et al.
2017/0233951 A1 8/2017 Burazin et al.
2019/0169796 A1 * 6/2019 Watkins ..... F26B 5/02
2019/0360154 A1 * 11/2019 Eagles ..... D21F 1/0036

* cited by examiner

METHOD AND APPARATUS FOR REMOVING WATER FROM A CAPILLARY CYLINDER IN A PAPERMAKING PROCESS

FIELD OF THE INVENTION

The present disclosure relates to methods and apparatuses for dewatering fibrous webs in a papermaking process, and more particularly, to methods and apparatuses for removing water from a capillary cylinder utilized in dewatering fibrous webs in a papermaking process.

BACKGROUND OF THE INVENTION

In papermaking processes, a papermaking furnish may be formed into a wet fibrous web, and in turn, various devices may be used to remove water from the advancing fibrous web. For example, some manufacturing configurations may include drying devices such as vacuum boxes, hot air dyers, capillary dewatering apparatuses, and Yankee dryers, such as disclosed in U.S. Pat. Nos. 3,301,746; 4,556,450; and 5,598,643.

Utilization of capillary cylinders to dewater a fibrous web can provide various advantages to papermaking processes. For example, a capillary cylinder may be configured to remove water from a fibrous web without heat or other means that may be evaporate water. As such, water removed from a fibrous web with a capillary cylinder may be reclaimed and reused in the papermaking process. In addition, removal of water from a fibrous web with a capillary cylinder may also help improve the effectiveness of downstream drying unit operations, such as a Yankee dryer.

In some configurations, the capillary dewatering apparatus may include a rotating capillary cylinder with a porous shell. During the manufacturing process, the wet fibrous web may be positioned on the capillary cylinder such that water is capillary transferred from the fibrous web into pores in the porous shell. The fibrous web may then advance from the capillary cylinder to additional drying and converting operations. The capillary dewatering apparatus may also include various systems to help increase the amount of water transferred from the fibrous web into the pores. For example, the capillary dewatering apparatus may include a vacuum system connected with the capillary cylinder to create a vacuum pressure within the cylinder. As such, the pneumatic pressure differential between the ambient atmospheric pressure exerted on the fibrous web and the level of vacuum pressure from within the cylinder helps to push water from the fibrous web into the pores. However, as the cylinder rotates, the porous shell may reach a limit of water absorption before the fibrous web advances from the drum. In turn, pressurized air may be used to expel water from the pores that are no longer covered by the fibrous web as the cylinder rotates before such pores are again covered by the advancing fibrous web.

Consequently, it would be beneficial to provide methods and apparatuses for increasing the amount of water that can be removed from a fibrous web with a capillary cylinder by removing water from the pores while the pores are covered with the fibrous web.

SUMMARY OF THE INVENTION

In one form, a method for removing water from a wet porous web comprises the steps of: providing a capillary porous media; positioning the web on the capillary porous media, wherein the web is positioned between the capillary porous media and an air-permeable fabric; providing an energy transfer surface in contact with the air-permeable fabric or the capillary porous media; and vibrating the capillary porous media with the energy transfer surface.

In another form, a method for removing water from a wet porous web comprises the steps of: rotating a roll about an axis of rotation, the roll comprising an outer circumferential surface comprising a capillary porous media, wherein the capillary porous media comprises a first surface and a second surface positioned radially inward of the first surface; advancing the web with an air-permeable fabric onto the roll, wherein the web is positioned between the capillary porous media and the air-permeable fabric; providing an ultrasonic horn in contact with the air-permeable fabric or the outer circumferential surface; and vibrating the capillary porous media with the ultrasonic horn to transfer water from the web through the first surface and radially inward toward the second surface.

In yet another form, an apparatus for removing water from a wet porous web comprises: a roll adapted to rotate about an axis of rotation, the roll comprising an outer circumferential surface comprising a capillary porous media, wherein the capillary porous media comprises a first surface and a second surface positioned radially inward of the first surface; an air-permeable fabric adapted to advance the web onto the roll, wherein the web is positioned between the capillary porous media and the air-permeable fabric; and an ultrasonic horn in contact with the air-permeable fabric.

DETAILED DESCRIPTION OF THE INVENTION

Figure 1:
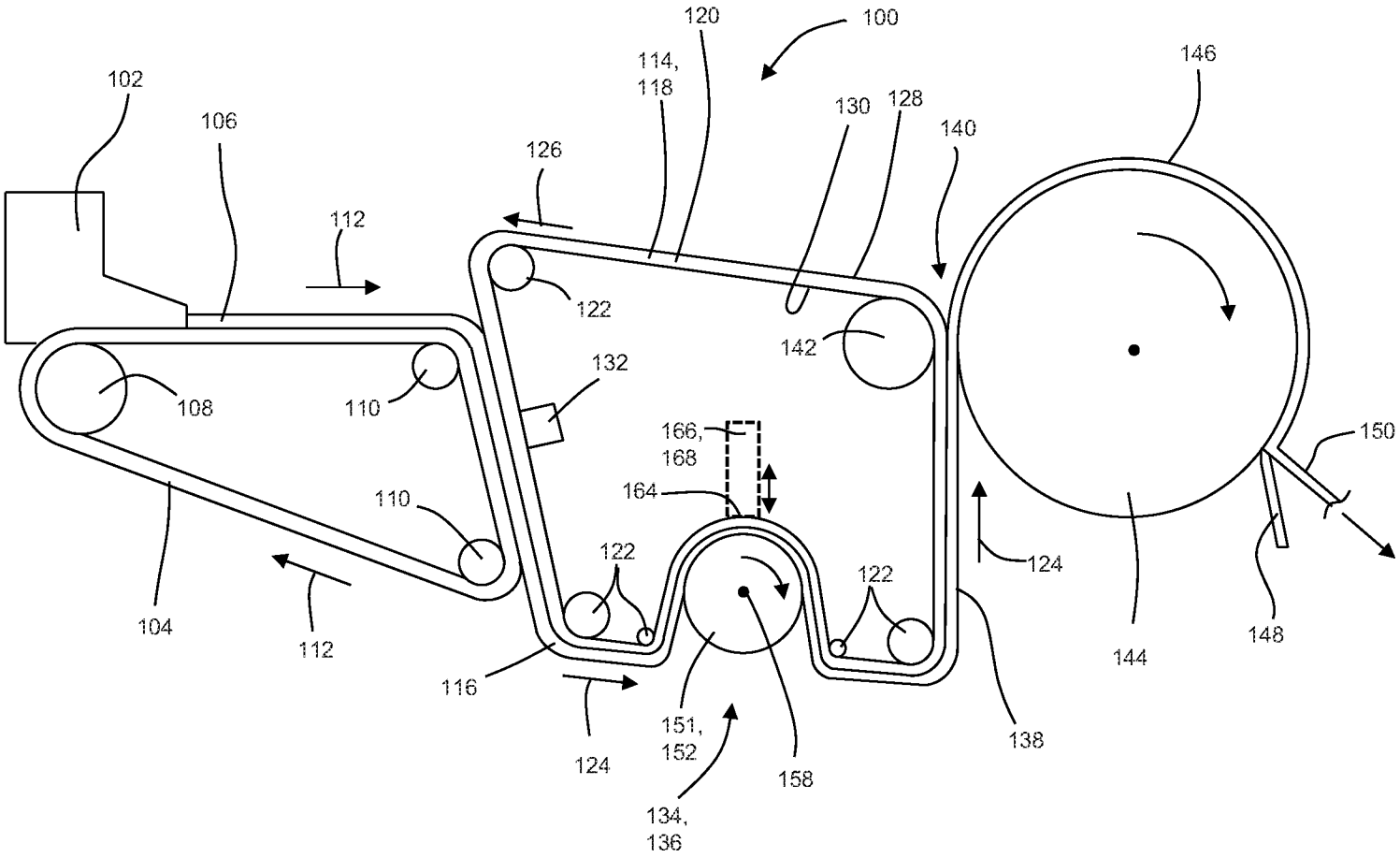
FIG. 1 is a schematic side view of an apparatus for producing fibrous structures.

Fibrous structures such as paper towels, bath tissues, and facial tissues may be made in a "wet laying" process in which a slurry of fibers, usually wood pulp fibers, is deposited onto a forming wire and/or one or more papermaking belts such that an embryonic fibrous structure can be formed, after which drying and/or bonding the fibers together results in a fibrous structure. Further processing the fibrous structure can be carried out such that a finished fibrous structure can be formed. For example, in typical papermaking processes, the finished fibrous structure is the fibrous structure that is wound on the reel at the end of papermaking, and can subsequently be converted into a finished product (e.g., a sanitary tissue product) by ply-bonding and embossing, for example. In general, the finished product can be converted "wire side out" or "fabric side out" which refers to the orientation of the sanitary tissue product during manufacture. That is, during manufacture, one side of the fibrous structure faces the forming wire, and the other side faces the papermaking belt, such as the papermaking belt disclosed herein.

The wet-laying process can be configured such that the finished fibrous structure has visually distinct features produced in the wet-laying process. Various forming wires and papermaking belts utilized can be configured to leave a physical, three-dimensional impression in the finished paper.

Such three-dimensional impressions are known in the art, particularly in the art of "through air drying" (TAD) processes, with such impressions often being referred to a "knuckles" and "pillows." Knuckles may be regions formed in the finished fibrous structure corresponding to the "knuckles" of a papermaking belt, i.e., the filaments or resinous structures that are raised at a higher elevation than other portions of the belt. Likewise, "pillows" may be regions formed in the finished fibrous structure at the relatively lower elevation regions between or around knuckles.

Thus, in the description below, the term "knuckles" or "knuckle region," or the like can be used for either the raised portions of a papermaking belt or the corresponding portions formed in the paper made on the papermaking belt, and the meaning should be clear from the context of the description herein. Likewise "pillow" or "pillow region" or the like can be used for either the portion of the papermaking belt between, within, or around knuckles (also referred to in the art as "deflection conduits" or "pockets"), or the relatively lower elevation regions between, within, or around knuckles in the paper made on the papermaking belt, and the meaning should be clear from the context of the description herein. In general, knuckles or pillows can each be continuous, semi-continuous or discrete, as described herein.

Knuckles and pillows in paper towels and bath tissue can be visible to the retail consumer of such products. The knuckles and pillows can be imparted to a fibrous structure from a papermaking belt in various stages of production, i.e., at various consistencies and at various unit operations during the drying process, and the visual pattern generated by the pattern of knuckles and pillows can be designed for functional performance enhancement as well as to be visually appealing. Such patterns of knuckles and pillows can be made according to the methods and processes described in U.S. Pat. Nos. 4,514,345; 6,398,910; and 6,610,173 as well as U.S. Patent Publication No. 2016/0159007 A1; and U.S. Patent Publication No. 2013/0199741 A1 that describe belts that are representative of papermaking belts made with cured polymer on a woven reinforcing member. Fabric creped belts can also be utilized, such as disclosed in U.S. Pat. Nos. 7,494,563; 8,152,958; and 8,293,072. It is to be appreciated that some papermaking belts may comprise resin molding or resin deflection members, such as disclosed in U.S. Pat. No. 9,322,136, which is incorporated by reference herein. Additional descriptions of resins on papermaking belts are disclosed in U.S. Patent Publication Nos. 2017/0233951 A1; 2016/0090693 A1; 2016/0090692 A1; and 2016/0090698 A1, which are all incorporated by reference herein. The present disclosure relates to methods for making fibrous webs, and in particular, to methods and apparatuses for removing water from a wet fibrous web during the manufacture of a fibrous structure. During the process of making a fibrous structure, various methods and apparatuses may be utilized to remove water from a wet porous web, such as a capillary dewatering apparatus. In some configurations, a capillary dewatering apparatus may include a capillary cylinder having an outer circumferential surface comprising a capillary porous media. A molding member, such as a papermaking belt comprising an air permeable fabric, may advance the wet fibrous web onto the rotating capillary cylinder. As such, the fibrous web is positioned between the capillary porous media and the air-permeable fabric. The capillary porous media comprises a first surface and a second surface positioned radially inward of the first surface, and water flows from the fibrous web through pores in the first surface and radially inward toward the second surface. The capillary dewatering apparatus may also include an energy transfer surface positioned in contact with the air-permeable fabric or the outer circumferential surface, wherein the energy transfer surface operates to vibrate the capillary porous media. In turn, the vibration helps to drive water from the first surface radially inward toward the second surface, allowing additional water to flow from the fibrous web and through pores in the capillary porous media. In some configurations, the energy transfer surface may comprise an ultrasonic apparatus.

It is to be appreciated that various process and equipment configurations may be used to make fibrous structures. For example, FIG. 1 illustrates one example of an apparatus 100 for making fibrous structures according to the present disclosure. As shown in FIG. 1, an aqueous dispersion of fibers (a fibrous furnish) may be supplied to a headbox 102 which can be of any design known to those of skill in the art. From the headbox 102, the aqueous dispersion of fibers can be delivered to a foraminous member 104, which may be configured as a Fourdrinier wire or as a twin wire configuration, to produce an embryonic fibrous web 106. The foraminous member 104 may be supported by a breast roll 108 and a plurality of return rolls 110 of which only two are illustrated. The foraminous member 104 may be propelled in the direction indicated by directional arrows 112 by a drive means, not illustrated. Optional auxiliary units and/or devices commonly associated with fibrous structure making machines and with the foraminous member 104, but not illustrated, comprise forming boards, hydrofoils, vacuum boxes, tension rolls, support rolls, wire cleaning showers, and other various components known to those of skill in the art.

After the aqueous dispersion of fibers is deposited onto the foraminous member 104, the embryonic fibrous web 106 is formed, typically by the removal of a portion of the aqueous dispersing medium by techniques, such as for example, vacuum boxes, forming boards, hydrofoils, and other various equipment known to those of skill in the art. The embryonic fibrous web 106 may travel with the foraminous member 104 about return roll 110 and may be brought into contact with a molding member 114. The molding member 114 may comprise an air permeable fabric 118. The embryonic fibrous web 106 is transferred from the foraminous member 104 onto molding member 114. The transfer may be completed by any means known to those of skill in the art including, but not limited to, vacuum transfer, rush transfer, couch transfer, or combinations thereof. Various approaches to transfer may include those described in U.S. Pat. Nos. 4,440,597; 5,830,321; 6,733,634; 7,399,378; and 8,328,985. During the transfer onto the molding member 114, the embryonic fibrous web 106 may be deflected into deflection conduits or molded into the topology of the molding member 114. In addition, while in contact with the molding member 114, the embryonic fibrous web 106 can be further dewatered to form an intermediate fibrous web 116. The molding member 114 can be in the form of an endless belt 120, also referred to herein as a papermaking belt. In this simplified representation of FIG. 1, the molding member 114 passes around and about molding member return rolls 122 and impression nip roll 124 and may advance travel in the direction indicated by directional arrows 126. Associated with the molding member 114, but not illustrated, can be various support rolls, other return rolls, cleaning means, drive means, and other various equipment known to those of skill in the art that may be used in fibrous structure making machines.

It is to be appreciated that the molding member 114 may be configured in various ways, such as an endless belt as just discussed or some other configuration, such as a stationary plate that may be used in making handsheets or a rotating drum that may be used with other types of continuous processes. As previously mentioned, the molding member 114 may comprise an air permeable fabric 118, and as such, the molding member 114 may be foraminous. As such, the forming member 114 may include continuous passages connecting a first surface 128 with a second surface 130. The first surface 128 (or "upper surface" or "working surface") may be configured as the surface with which the embryonic fibrous web 118 is associated. And the second surface 130 (or "lower surface) may be configured as the surface with which the molding member return rolls 122 are associated. Thus, the molding member 114 may be constructed in such a manner that when water is caused to be removed from the embryonic fibrous web 106 and/or intermediate fibrous web 116 in the direction of the molding member 114, such as by the application of differential fluid pressure such with a vacuum box 132, the water may be discharged from the apparatus 100 without having to again contact the embryonic fibrous web 106 in either a liquid state or vapor state.

As previously mentioned, various methods and apparatuses may be used to dry the intermediate fibrous web 116. Examples of such suitable drying process include subjecting the intermediate fibrous web 116 to conventional and/or flow-through dryers and/or Yankee dryers. In one example of a drying process, the intermediate fibrous web 116 in association with the molding member 114 passes around the molding member return rolls 122 and travels in the direction indicated by directional arrows 126. The intermediate fibrous web 116 may advance to a predryer section or system 134. The predryer system may 134 may include a conventional flow-through dryer (hot air dryer) and/or a capillary dewatering apparatus 136, such as shown in FIG. 1 and discussed in more detail below. Although the capillary dewatering apparatus 136 is described herein in the context of the predryer system 134 with the accompanying figures, it is to be appreciated that the capillary dewatering apparatus 136 herein may be utilized in various other configurations in a papermaking process. For example, the predryer system 134 may include a single roll or multiple separate rolls, such as a predryer system that includes a predryer roll and a separate capillary dewatering roll. In turn, a predried fibrous web 138, which may be associated with the molding member 114, advances from the predryer system 134 to a nip 140 between an impression nip roll 142 and a Yankee dryer 144. In some configurations, the predried fibrous web 138 advancing from the predryer system 134 may have a consistency of from about 30% to about 98%. A pattern formed by the first surface 128 of the molding member 114 may be impressed into the predried fibrous web 138 to form discrete elements (relatively high density) or, alternatively, a substantially continuous network (relatively high density) imprinted in a fibrous web 146. The imprinted fibrous web 146 may then be adhered to a surface of the Yankee dryer 144. The Yankee dryer may operate to dry the imprinted fibrous web to a consistency of at least about 95%. In some configurations, the drying process used to dry the intermediate fibrous web 116 may comprise through air dyers or pre-dryers without any Yankee dryer, which dry the web to a consistency of at least about 90% or at least about 95%. Such a process is described in U.S. Pat. No. 5,607,551, which is incorporated by reference herein.

With continued reference to FIG. 1, the imprinted fibrous web 146 may then be foreshortened by creping the web 146 with a creping blade 148 to remove the web 146 from the surface of the Yankee dryer 146 resulting in the production of a creped fibrous structure 150. In some operations, foreshortening may refer to the reduction in length of a dry (having a consistency of at least about 90% and/or at least about 95%) fibrous web which occurs when energy is applied to the dry fibrous web in such a way that the length of the fibrous web is reduced and the fibers in the fibrous web are rearranged with an accompanying disruption of fiber-fiber bonds. The aforementioned method of foreshortening may be referred to as dry creping. It is to be appreciated that foreshortening may be accomplished in various additional ways, such as wet creping, wet microcontraction, and fabric creping. The creped fibrous structure 150 may also be subjected to post processing steps, such as calendaring, tuft generating operations, embossing, and/or converting.

Figure 2:
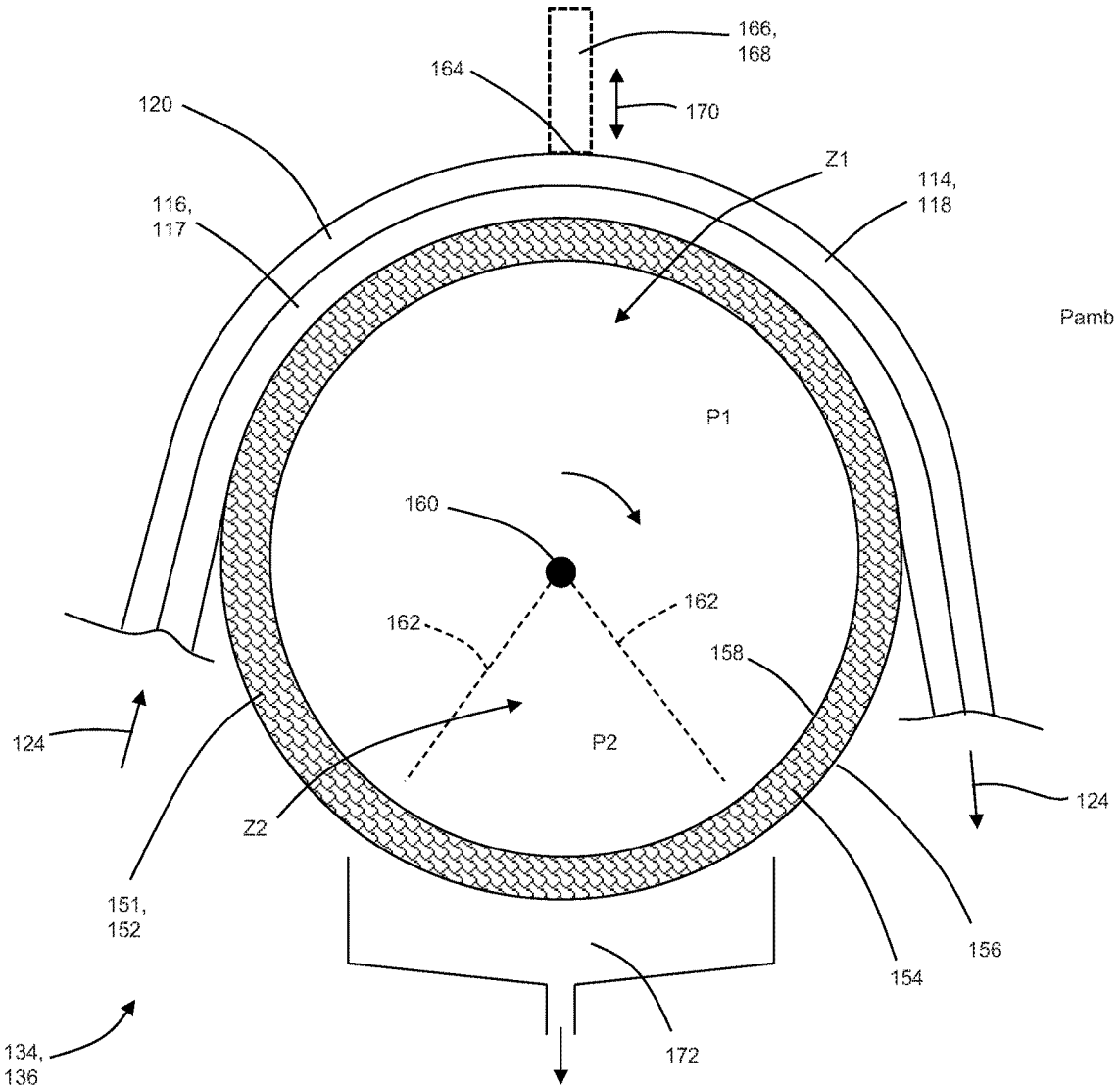
FIG. 2 is a detailed schematic side view of a capillary dewatering apparatus configured with an energy transfer surface positioned in contact with an air permeable fabric.

As previously mentioned, the predryer system 134 may include a capillary dewatering apparatus 136. As shown in FIGS. 1 and 2, the capillary dewatering apparatus 136 may include a roll 151 that may be configured as a capillary cylinder 152 comprising a capillary porous media 154 including a first surface 156 and a second surface 158. The first surface 156 may define an outer circumferential surface of the capillary cylinder 152, and the second surface 158 may be positioned radially inward of the first surface 156. The capillary porous media 154 includes pores adapted to receive and conduct liquid from first surface 156 radially inward toward the second surface 158. It is to be appreciated that the pores may be configured with various sizes. In some configurations, the pores may comprise effective diameters in the range of about 0.8 μm to about 10 μm. As used herein, the term effective diameter means that the pore acts, at least in the capillary sense, the same as a cylindrical pore of the stated diameter albeit the pore of interest may have an irregular shape, i.e., not circular or cylindrical. The capillary cylinder 152 may also be adapted to rotate about an axis of rotation 160. The inner radial volume of the capillary cylinder 152 may also be segmented into various zones, having different air pressures and wherein various different operations may be carried out. For example, as shown in FIG. 2, the capillary cylinder 152 may include a first zone Z1 having a pressure P1 exerted on the second surface 158 and a second zone Z2 having a pressure P2 exerted on the second surface 158. In some configurations, a vacuum air system may be fluidly connected with the first zone Z1 such that pressure P1 is a vacuum pressure that is below an ambient pressure Pamb, and a positive pressure air system may be fluidly connected with the second zone Z2 such that pressure P2 is a positive pressure that is above the ambient pressure Pamb. For the purposes of clarity, dashed lines 162 are shown in FIG. 2 to represent example boundaries between the first zone Z1 and the second zone Z2. It is to be appreciated that the capillary cylinder 152 and the capillary porous media 154 may be configured in various ways, such as disclosed for example, in U.S. Pat. Nos. 4,556,450 and 5,598,643, both of which are incorporated herein by reference.

Figure 3:
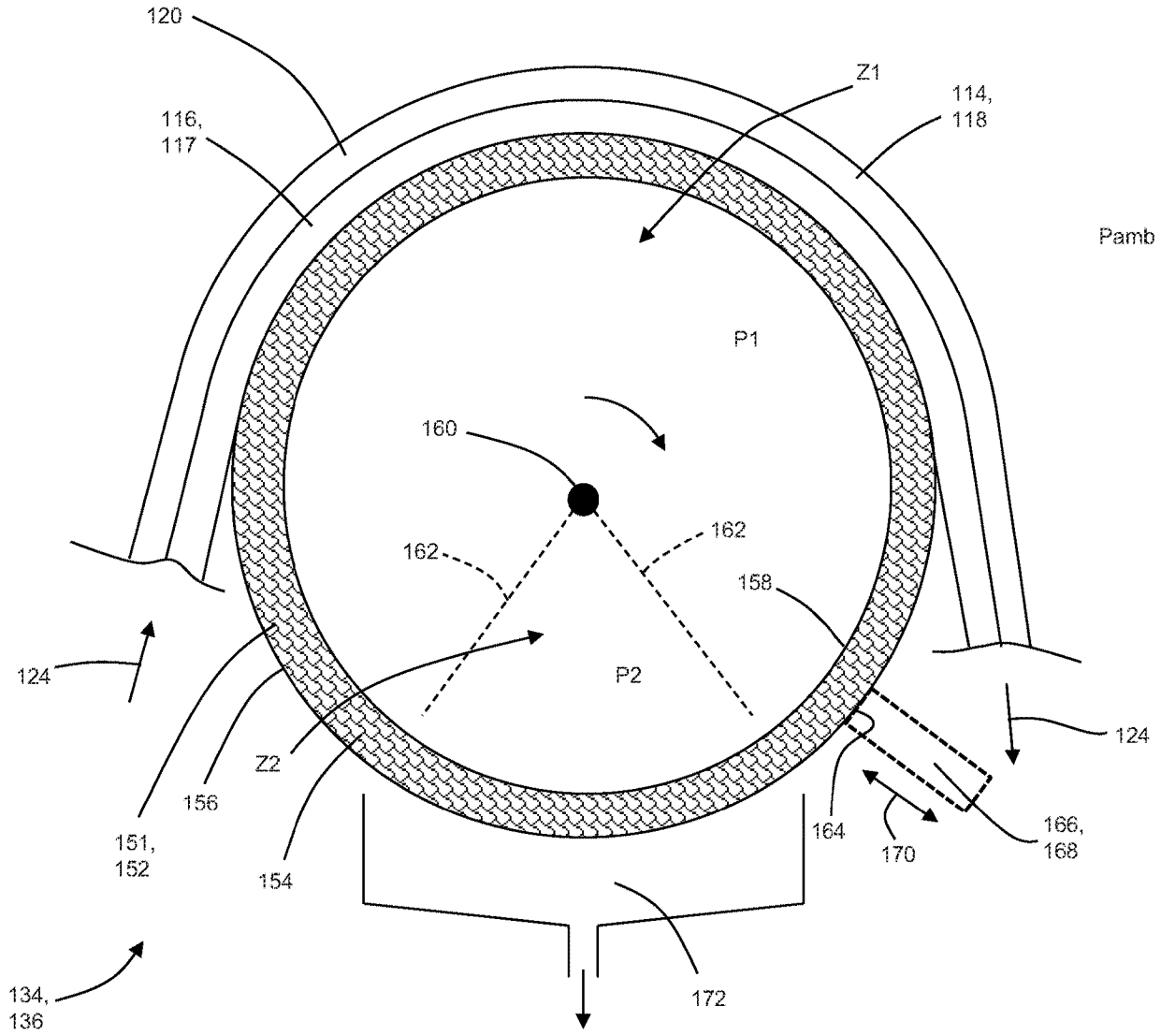
FIG. 3 is a detailed schematic side view of a capillary dewatering apparatus configured with an energy transfer surface positioned in contact with a capillary porous media.

With continued reference to FIGS. 1 and 2, the capillary dewatering apparatus 136 may include at least one energy transfer surface 164 that may be positioned in contact with the second surface 130 of the molding member 114. The energy transfer surface 164 is generically represented by a dashed-line rectangle in FIGS. 1-3. During operation, the energy transfer surface 164 operates to vibrate the capillary porous media 154 to help drive liquid from the pores in the first surface 156 radially inward toward the second surface 158. It is to be appreciated that the energy transfer surface 164 may be configured to vibrate at various frequencies and/or peak to peak displacements. In some configurations, the energy transfer surface 164 vibrates with a peak to peak displacement of up to about 20 μm. It is to be appreciated that the capillary dewatering apparatus 136 may include one or more energy transfer surfaces 164 are positioned in contact with one or more of the various components of the capillary dewatering apparatus 136 to induce vibration therein. For example, one or more energy transfer surfaces 164 may be positioned in contact with the molding member 114 and/or the roll 151. When an energy transfer surface 164 is positioned in contact with the molding member 114, vibration from the energy transfer surface 164 may be transferred through the molding member 114 and the intermediate fibrous web 116 to the capillary porous media 154. FIG. 3 illustrates a configuration wherein the energy transfer surface 164 may be positioned in contact with the roll 151, and as such, vibration from the energy transfer surface 164 may be transferred directly to the capillary porous media 154. It is to be appreciated that an energy transfer surface 164 may be positioned in contract with the first surface 156 and/or the second surface 158 the capillary porous media 154.

It is to be appreciated that the energy transfer surface 164 may be configured in various ways. For example, the energy transfer surface 164 may comprise an energy transfer surface of an ultrasonic apparatus 166. As such, the ultrasonic apparatus 166 may include a horn 168, wherein the ultrasonic apparatus 166 may apply energy to the horn 168 to create resonance of the horn 168 at frequencies and amplitudes so the horn vibrates rapidly in a direction 170. As such, horn 168 may be configured to impart ultrasonic energy to the molding member 114 and/or the capillary cylinder 152 to vibrate the capillary porous media 154. In some ultrasonic device configurations, a generator and stack arrangement may be utilized, wherein the stack may include a transducer module, an amplifier module, and a horn or sonotrode. The generator is adapted to create an electrical signal at a desired frequency and power that may be sent to the stack through a cable. In turn, the transducer module converts the electrical signal to vibration; the amplifier module amplifies the vibration; and the horn or sonotrode comprises the vibrating surface adapted to contact a work piece, such as the molding member 114 and/or the capillary cylinder 152. In some configurations, the generator may include a DYNAMIC digital control XX and the stack may include an Indexed Quick Change Weld Horn Stack 20 kHz, drawing number 180.648.3, available from Herrmann Ultrasonic, Inc. In some configurations, the generator may include a Generator 900DA and the stack may include a 900 Series Stacker, Model 900ae, available from BRANSON Ultrasonics. It is to be appreciated that aspects of the ultrasonic apparatuses 166 may be configured in various ways, such as for example linear or rotary type configurations, and such as disclosed for example in U.S. Pat. Nos. 3,113,225; 3,562,041; 3,733,238; 5,110,403; 6,036,796; 6,508,641; and 6,645,330. In some configurations, the ultrasonic apparatus 166 may be configured as a linear oscillating type sonotrode, such as for example, available from Herrmann Ultrasonic, Inc. In some configurations, the sonotrode may include a plurality of sonotrodes nested together in an axial direction along the axis of rotation 160. In some configurations, horns 168 may be arranged circumferentially about the axis of rotation 160. Various sonotrodes and various cross directional and/or circumferential sonotrode arrangements are available from Herrmann Ultrasonic, Inc. and BRANSON Ultrasonics.

During operation, the molding member 114 advances the wet fibrous web 117 onto the rotating capillary cylinder 152, wherein the wet fibrous web 117 is positioned between the capillary porous media 154 and the air-permeable fabric 118 of the molding member 114. As the capillary cylinder 152 rotates, water or other liquids may be transferred from a wet fibrous web 117, such as the intermediate fibrous web 116 described above, and through pores in the first surface 156 of the capillary cylinder 152. The pneumatic pressure differential between the ambient pressure Pamb exerted on the wet fibrous web 117 and the vacuum pressure P1 from within the capillary cylinder 152 helps to push liquid from the fibrous web 117 into the pores in the first surface 156 of the capillary porous media 154. In addition, the energy transfer surface 164 operates to vibrate the capillary porous media 154, wherein the vibration helps to drive liquids from the first surface 156 radially inward toward the second surface 158. As such, additional liquid can flow from the fibrous web 117 and through the pores in the capillary porous media 154. The molding member 114 then advances the wet fibrous web 117 from the rotating capillary cylinder 152, and the pressurized air P2 may expel liquid from the pores that are no longer covered by the fibrous web 117. As shown in FIG. 2, the liquid may be expelled from the capillary cylinder into a drain system 172 wherein the water can be reclaimed and/or reused. It is to be appreciated that various amounts of energy may be required to remove water from the fibrous web 117. For example, in some configurations, the energy required to remove 1 pound of water from the fibrous web 117 may be from about 1 BTU/lb to about 20 BTU/lb, specifically reciting all 1 BTU/lb increments within the above-recited range and all ranges formed therein or thereby.

This application claims the benefit of U.S. Provisional Application No. 62/595,184, filed on Dec. 6, 2017, the entirety of which is incorporated by reference herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for removing water from a wet porous web, the method comprising the steps of:

providing a capillary porous media;

positioning the web on the capillary porous media, wherein the web is positioned between the capillary porous media and an air-permeable fabric;

providing an energy transfer surface;

contacting the air-permeable fabric or the capillary porous media with the energy transfer surface; and vibrating the capillary porous media with the energy transfer surface.

2. The method of claim 1, wherein the energy transfer surface comprises an ultrasonic horn.

3. The method of claim 2, wherein the ultrasonic horn comprises a linear ultrasonic horn.

4. The method of claim 2, wherein the ultrasonic horn comprises a rotary ultrasonic horn.

5. The method of claim 1, wherein the step of vibrating further comprises moving the energy transfer surface with a peak to peak displacement up to about 20 μm.

6. The method of claim 5, wherein the step of vibrating further comprises vibrating the energy transfer surface at a frequency of about 20 kHz.

7. The method of claim 1, wherein the capillary porous media comprises a first surface and a second surface positioned opposite the first surface, wherein water flows from the web through the first surface and toward the second surface.

8. The method of claim 7, applying vacuum to a first portion of the second surface.

9. The method of claim 8, further comprising the step of advancing the web from a roll and applying a positive air pressure to a second portion of the second surface.

10. The method of claim 1, wherein the capillary porous media comprises pores comprising effective diameters in a range of about 0.8 μm to about 10 μm.

11. The method of claim 1, wherein energy applied to remove water from the web is from about 1 BTU/lb of water to about 20 BTU/lb of water.

12. The apparatus of claim 1, wherein the air-permeable fabric comprises resin deflection members supporting the web.

13. A method for removing water from a wet porous web, the method comprising the steps of:

rotating a roll about an axis of rotation, the roll comprising an outer circumferential surface comprising a capillary porous media, wherein the capillary porous media comprises a first surface and a second surface positioned radially inward of the first surface;

advancing the web with an air-permeable fabric onto the roll, wherein the web is positioned between the capillary porous media and the air-permeable fabric;

providing an ultrasonic horn;

contacting the air-permeable fabric or the outer circumferential surface with the ultrasonic horn; and vibrating the capillary porous media with the ultrasonic horn to transfer water from the web through the first surface and radially inward toward the second surface.

14. The method of claim 13, wherein the ultrasonic horn comprises a linear ultrasonic horn.

15. The method of claim 13, wherein the ultrasonic horn comprises a rotary ultrasonic horn.

16. The method of claim 13, wherein the ultrasonic horn vibrates with a peak to peak displacement of about 20 μm.

17. The method of claim 13, applying vacuum pressure to a portion of the second surface.

18. The method of claim 13, wherein the capillary porous media comprises pores comprising effective diameters in a range of about 0.8 μm to about 10 μm.

19. An apparatus for removing water from a wet porous web, the apparatus comprising:

a roll adapted to rotate about an axis of rotation, the roll comprising an outer circumferential surface comprising a capillary porous media, wherein the capillary porous media comprises a first surface and a second surface positioned radially inward of the first surface;

an air-permeable fabric adapted to advance the web onto the roll, wherein the web is positioned between the capillary porous media and the air-permeable fabric; and an ultrasonic horn in contact with the air-permeable fabric.

20. The apparatus of claim 19, wherein the ultrasonic horn vibrates with a peak to peak displacement of up to about 20 μm.

21. The apparatus of claim 19, wherein the capillary porous media comprises pores comprising effective diameters in a range of about 0.8 μm to about 10 μm.

22. The apparatus of claim 19, wherein the ultrasonic horn comprises a linear ultrasonic horn.

23. The apparatus of claim 19, wherein the air-permeable fabric comprises resin deflection members supporting the web.

* * * * *